US010182605B1

(12) United States Patent
Cleveland

(10) Patent No.: US 10,182,605 B1
(45) Date of Patent: Jan. 22, 2019

(54) UV RAY-BLOCKING HEADWEAR

(71) Applicant: Robert Cleveland, Orlando, FL (US)

(72) Inventor: Robert Cleveland, Orlando, FL (US)

( * ) Notice: Subject to any disclaimer, the term of this patent is extended or adjusted under 35 U.S.C. 154(b) by 375 days.

(21) Appl. No.: 15/181,518

(22) Filed: Jun. 14, 2016

Related U.S. Application Data

(60) Provisional application No. 62/211,573, filed on Aug. 28, 2015.

(51) Int. Cl.

| | |
|---|---|
| ***A42B 1/18*** | (2006.01) |
| ***A42C 5/02*** | (2006.01) |
| ***A42C 5/04*** | (2006.01) |
| ***A42B 1/20*** | (2006.01) |
| ***A42B 1/00*** | (2006.01) |
| ***A42B 1/06*** | (2006.01) |

(52) U.S. Cl.

CPC ..... *A42B 1/18* (2013.01); *A42B 1/006* (2013.01); *A42B 1/008* (2013.01); *A42B 1/065* (2013.01); *A42B 1/201* (2013.01); *A42B 1/205* (2013.01); *A42B 1/206* (2013.01); *A42B 1/208* (2013.01); *A42C 5/02* (2013.01); *A42C 5/04* (2013.01)

(58) Field of Classification Search

CPC ..... A42B 1/18; A42B 1/006; A42B 1/008; A42B 1/065; A42B 1/201; A42B 1/205; A42B 1/206; A42B 1/208; A42C 5/02; A42C 5/04

USPC ..... 2/171.01, 171.03, 171.04, 184.5, 182.6, 2/182.2, DIG. 11

See application file for complete search history.

(56) References Cited

U.S. PATENT DOCUMENTS

| | | | | | |
|---|---|---|---|---|---|
| 213,415 | A * | 3/1879 | Halvorson | A42B 1/201 | 2/171.03 |
| 218,498 | A * | 8/1879 | Davis | A42B 1/041 | 2/171.04 |
| 229,464 | A * | 6/1880 | Ray | A42B 1/201 | 2/171.03 |
| 250,803 | A * | 12/1881 | Gray | A42B 1/201 | 2/171.03 |
| 857,434 | A * | 6/1907 | Behringer | A42B 1/201 | 2/171 |
| 2,227,554 | A * | 1/1941 | Riordon | A42B 1/201 | 135/16 |
| 3,150,380 | A * | 9/1964 | Porcello | A42C 5/04 | 2/10 |

(Continued)

FOREIGN PATENT DOCUMENTS

JP WO 2010143287 A1 * 12/2010 ..... A44B 17/007

OTHER PUBLICATIONS

WO2010143287, Machine Translated on Jul. 31, 2018.*
WO2007084300, Judson, Ward, M.*

*Primary Examiner* — Khaled Annis
*Assistant Examiner* — Dakota Marin
(74) *Attorney, Agent, or Firm* — Kyle A. Fletcher, Esq.

(57) ABSTRACT

The UV ray-blocking headwear is adapted to be an apparel item. The UV ray-blocking headwear is adapted to be worn on the head. The UV ray-blocking headwear is a UV blocking sunshield that is attaches to the head such that UV radiation is prevented from reaching the head, ears, or nape of the neck. The UV ray-blocking headwear is attached to a headband that is worn on the head such that a sunshield is raised above the head thereby creating a space for air flow to provide for the comfort of the user. The UV ray-blocking headwear comprises a headband, a plurality of struts and a sunshield.

11 Claims, 5 Drawing Sheets

(56) References Cited

U.S. PATENT DOCUMENTS

| | | | | | |
|---|---|---|---|---|---|
| 4,109,322 | A * | 8/1978 | Ott | A42C 5/04 | 135/16 |
| 4,468,817 | A * | 9/1984 | Nunnery | A42B 3/10 | 2/181 |
| 4,760,610 | A * | 8/1988 | Wu | A42B 1/201 | 135/16 |
| 2004/0163158 | A1 * | 8/2004 | Broome | A42C 5/04 | 2/184.5 |

* cited by examiner

UV RAY-BLOCKING HEADWEAR

CROSS REFERENCES TO RELATED APPLICATIONS

This non-provisional application claims priority under 35 USC 119(e) to United States provisional application U.S. 62/211,573 filed on Aug. 28, 2015 by the inventor: Robert G Cleveland Sr of Orlando, Fla.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of headwear and hats, more specifically, a hat adapted to protect the head, ears, and nape of the neck from ultraviolet radiation exposure.

Hats are a common and effective means of protecting the head of a person from excessive exposure to UV radiation through sunlight, which is a known cause of skin cancer. One shortcoming of hats is that hats fit tightly to the head, while providing adequate protection, will: 1) prevent air flow around the head; and, 2) retain unwanted heat and moisture next to the head. This often results in hats being uncomfortable to use during hot sunny days. Obviously, there is a need for a structure that protects the head from UV radiation without closely fitting the head.

SUMMARY OF INVENTION

The UV ray-blocking headwear is adapted to be an apparel item. The UV ray-blocking headwear is adapted to be worn on the head. The UV ray-blocking headwear is a UV blocking sunshield that is attaches to the head such that UV radiation is prevented from reaching the head, ears, or nape of the neck. The UV ray-blocking headwear is attached to a headband that is worn on the head such that a sunshield is raised above the head thereby creating a space for air flow to provide for the comfort of the user.

These together with additional objects, features and advantages of the UV ray-blocking headwear will be readily apparent to those of ordinary skill in the art upon reading the following detailed description of the presently preferred, but nonetheless illustrative, embodiments when taken in conjunction with the accompanying drawings.

In this respect, before explaining the current embodiments of the UV ray-blocking headwear in detail, it is to be understood that the UV ray-blocking headwear is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the UV ray-blocking headwear.

It is therefore important that the claims be regarded as including such equivalent construction insofar as they do not depart from the spirit and scope of the UV ray-blocking headwear. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
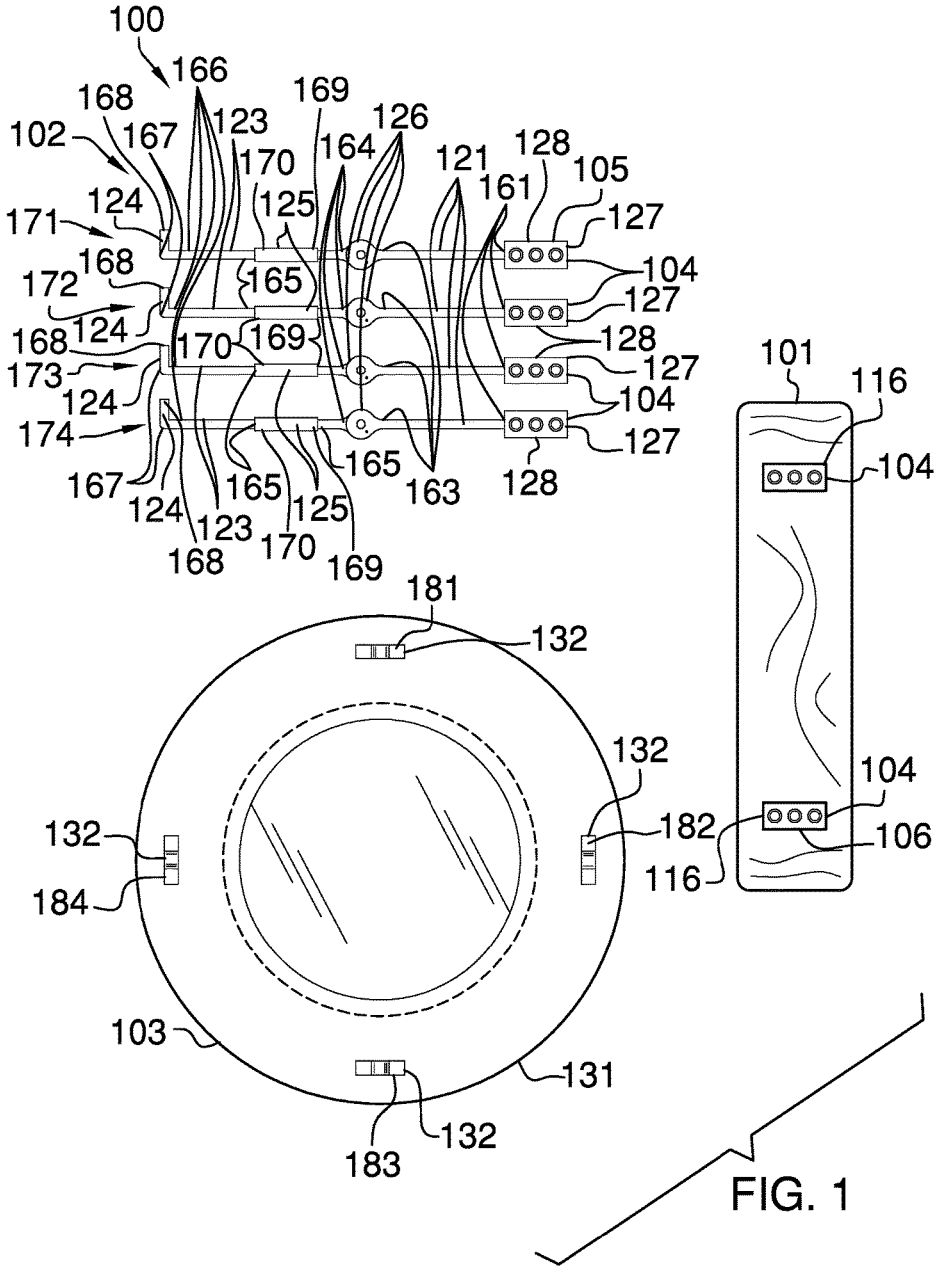
FIG. 1 is a full view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The UV ray-blocking headwear 100 (hereinafter invention) comprises a headband 101, a plurality of struts 102, a sunshield 103, and a plurality of snaps 104. The invention 100 is adapted to be an apparel item. The invention 100 is adapted to be worn on the head 141. The invention 100 is a UV blocking sunshield 103 that is attached to the head 141 such that UV radiation is prevented from reaching the head 141, ears 142, or nape of the neck 143. The invention 100 is attached to a headband 101 that is worn on the head 141 such that the sunshield 103 is raised above the head 141 thereby creating a space for air flow 144 to provide for the comfort of the head 141.

The plurality of snaps 104 are commercially available snaps that are used to attach the plurality of struts 102 to the headband 101. Each of the plurality of snaps 104 further comprises a male snap and a female snap, which can be accumulated into a plurality of male snaps 111 and a plurality of female snaps 112 respectively. Any male snap selected from the plurality of male snaps 111 will attach to any female snap selected from the plurality of female snaps 112. The plurality of male snaps 111 and the plurality of female snaps 112 are discussed elsewhere in this disclosure.

The headband 101 comprises a commercially available elastic band that is worn around the head 141. The headband 101 is selected with a modulus such that the relaxation force of the elasticity of the elastic band will provide adequate friction against the head such that the plurality of struts 102 and the sunshield 103 can be supported by the head 141. In a second potential embodiment of the disclosure, the headband 101 comprises a non elastic webbing that is secured to the head 141 with a hook or loop fastener or other fastener. As shown most clearly in FIG. 2, the headband 101 further comprises a first plurality of fasteners 116, which is selected from the group consisting of the plurality of male snaps 111 or the plurality of female snaps 112. The first plurality of fasteners 116 attach to the surface of the headband 101 that is distal from the head 141 when the headband 101 is worn normally.

Each of the plurality of struts 102 comprises a first shaft 121, a second shaft 122, a third shaft 123, a fourth shaft 124, a threaded connector 125, a pivot 126, a second plurality of fasteners 127, and a mounting plate 128. The first shaft 121 is a shaft that is further defined with a first end 161 and a second end 162. The second shaft 122 is a shaft that is further defined with a third end 163 and a fourth end 164. The fourth end 164 is formed with an exterior screw thread. The third shaft 123 is a shaft that is further defined with a fifth end 165 and a sixth end 166. The fifth end 165 is formed with an exterior screw thread. The fourth shaft 124 is a shaft that is further defined with a seventh end 167 and an eighth end 168. The threaded connector 125 and the pivot 126 are used to interconnect the first shaft 121, the second shaft 122, the third shaft 123, and the fourth shaft 124. The mounting plate 128 is a rectangular plate upon which the second plurality of fasteners 127 are attached. The second plurality of fasteners 127 are a subset of fasteners selected from the group remaining in the group consisting of the plurality of male snaps 111 or the plurality of female snaps 112 after the first plurality of fasteners 116 has been selected.

The second plurality of fasteners 127 are positioned on the mounting plate 128 such that when the invention 100 is assembled the second plurality of fasteners 127 will align with a selected subset of the first plurality of fasteners 116 that are mounted on the headband 101 such that the second plurality of fasteners 127 will attach to the selected subset of the first plurality of fasteners 116. The threaded connector 125 is a pipe that is formed with an interior screw thread. The span of the inner diameter of the threaded connector 125 is greater than the span of the outer diameter of the second shaft 122 and the span of the outer diameter of the third shaft 123. The threaded connector 125 is further defined with a ninth end 169 and a tenth end 170. The pivot 126 is a commercially available locking pivot hinge that is used to adjust the radial angle 129 between the first shaft 121 and the second shaft 122. This allows the sunshield 103 to be adjusted such a position perpendicular to the direction of the ultraviolet radiation.

Figure 2:
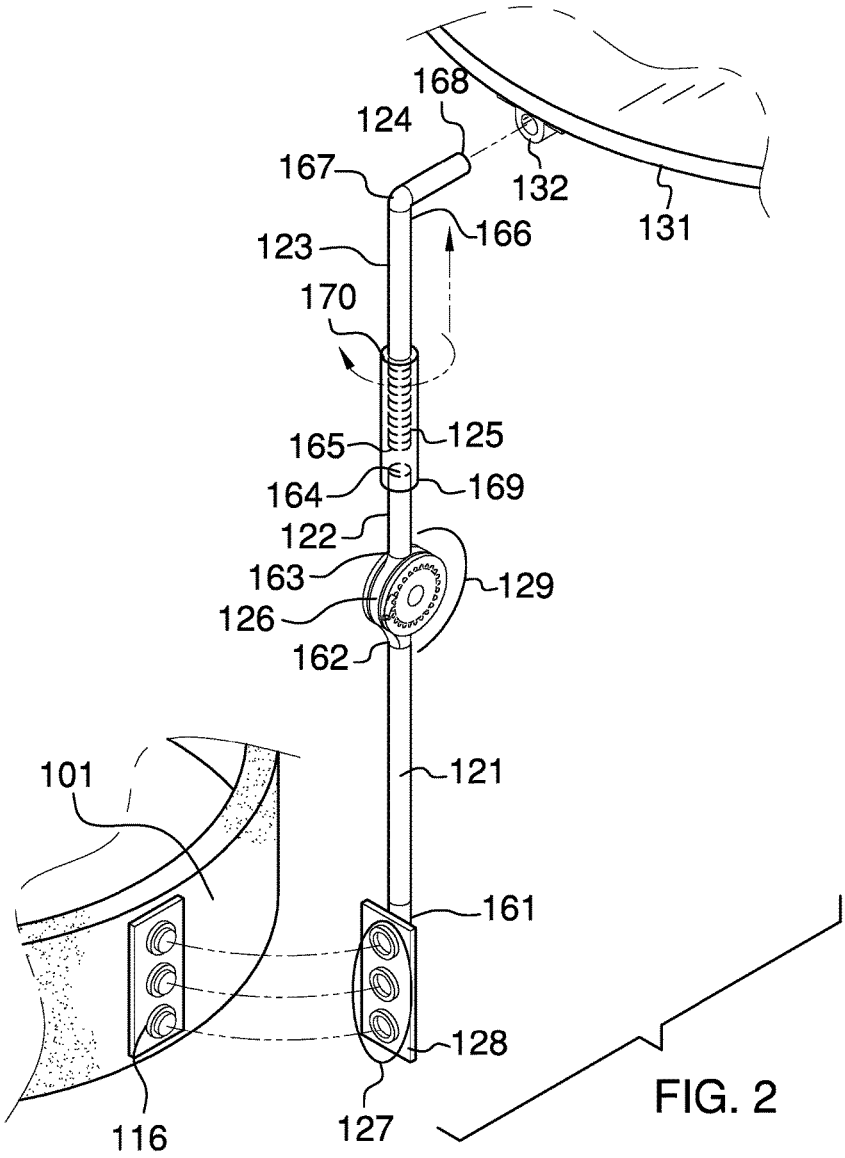
FIG. 2 is an exploded view of an embodiment of the disclosure.
Figure 3:
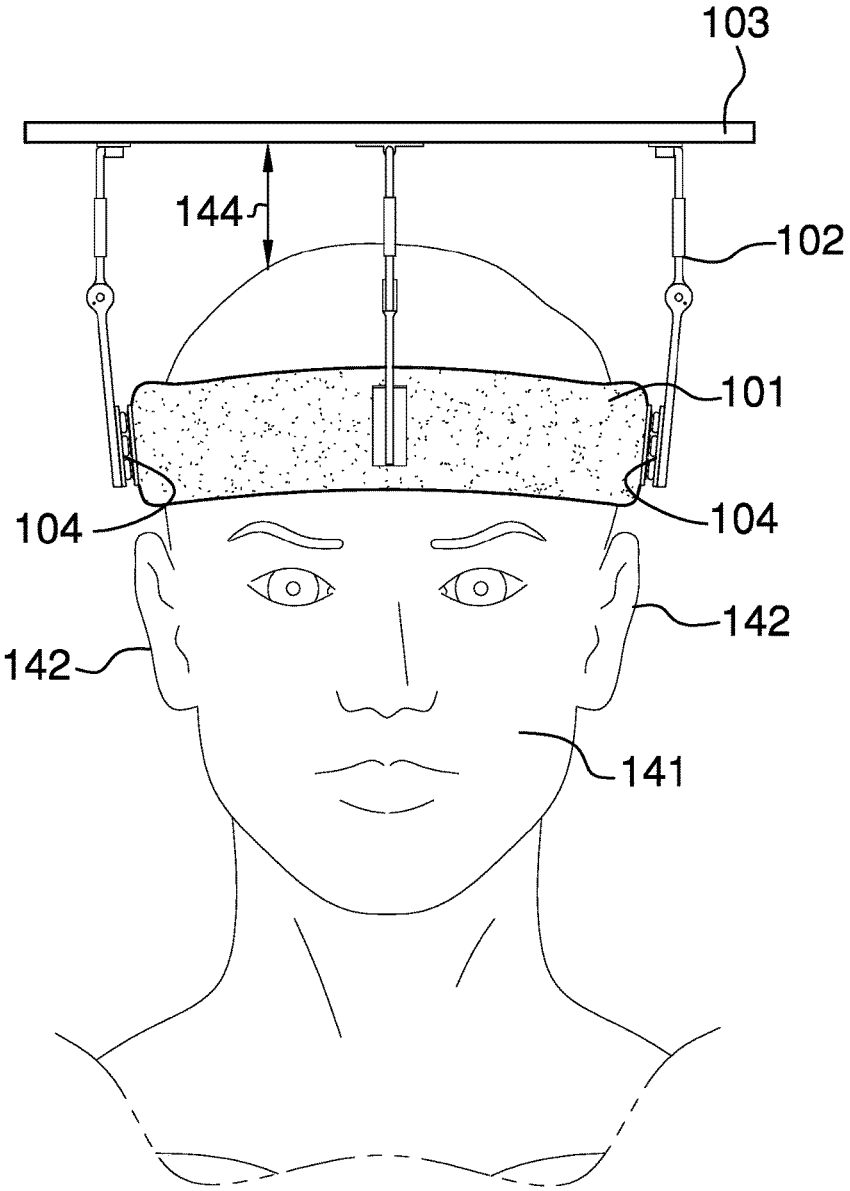
FIG. 3 is a front in use view of an embodiment of the disclosure.
Figure 4:
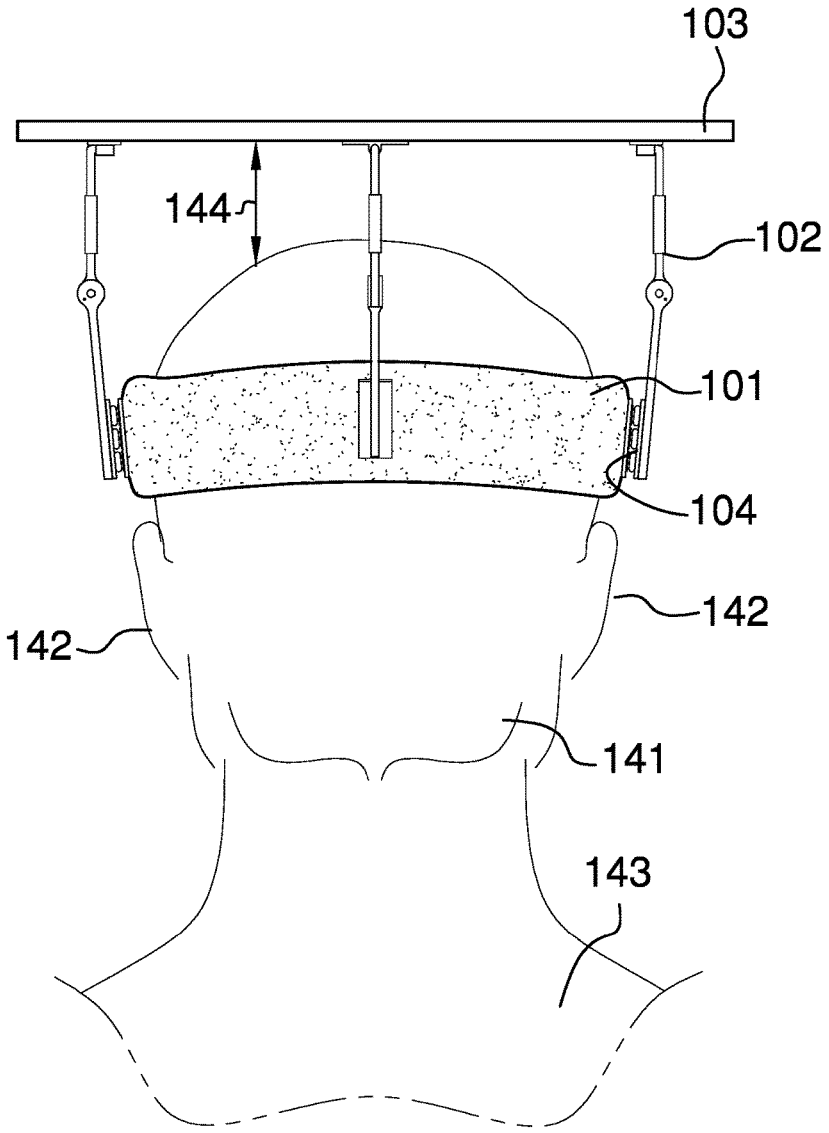
FIG. 4 is a rear in use view of an embodiment of the disclosure.
Figure 5:
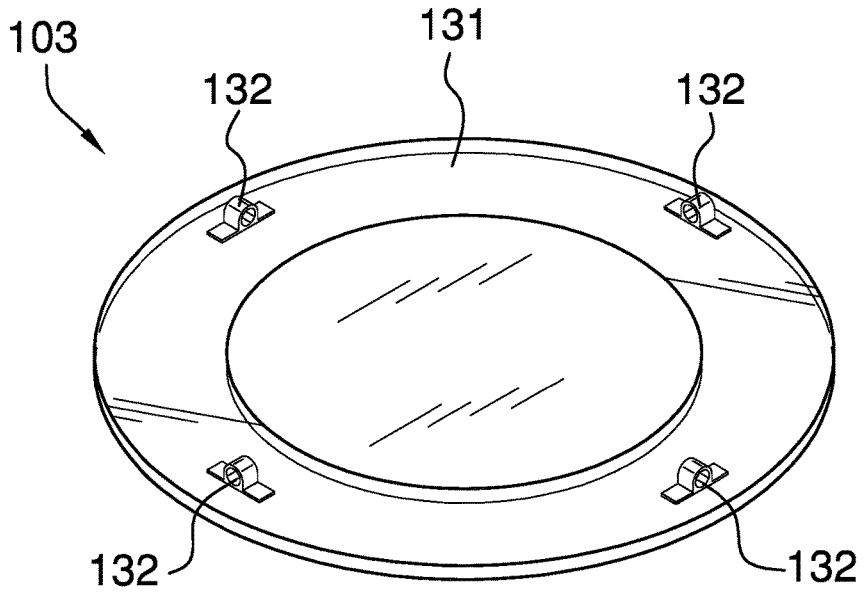
FIG. 5 is a detail view of an embodiment of the disclosure.

As shown most clearly in FIG. 2, each of the plurality of struts 102 is assembled as described in this paragraph. The mounting plate 128 is attached to the first end 161 of the first shaft 121. The second end 162 of the first shaft 121 is attached to pivot 126. The third end 163 of the second shaft 122 is attached to pivot 126. The fourth end 164 of the second shaft 122 screws into the ninth end 169 of the threaded connector 125. The fifth end 165 of the third shaft 123 screws into the tenth end 170 of the threaded connector 125. The seventh end 167 of the fourth shaft 124 is attached to the sixth end 166 of the third shaft 123 such that the center axis of the fourth shaft 124 is perpendicular to the center axis of the third shaft 123. The eighth end 168 of the fourth shaft 124 is free and will be discussed elsewhere in this disclosure. Methods to make the attachments described in this disclosure are well known and documented in the mechanical arts.

The sunshield 103 comprises a disk 131 and a plurality of connectors 132. The disk 131 is the physical barrier that inhibits the UV radiation from reaching the head 141. The disk 131 is made from a material selected from the group consisting of an opaque material or a filtering material that inhibits the passage of radiation with wavelengths less than 400 nm. While the disk 131 shape is preferred, alternate shapes and forms may be used in the construction of the sunshield 103. The disk 131 has attached to it a plurality of connectors 132. Each of the plurality of connectors 132 is a readily and commercially available two holed pipe strap that is designed to receive the eighth end 168 of the fourth shaft 124.

In the first potential embodiment of the disclosure, the plurality of struts 102 further comprises a first strut 171, a second strut 172, a third strut 173, and a fourth strut 174. The plurality of connectors 132 further comprises a first connector 181, a second connector 182, a third connector 183, and a fourth connector 184. The eighth end 168 of the fourth shaft 124 of the first strut 171 is inserted into the first connector 181. The eighth end 168 of the fourth shaft 124 of the second strut 172 is inserted into the second connector 182. The eighth end 168 of the fourth shaft 124 of the third strut 173 is inserted into the third connector 183. The eighth end 168 of the fourth shaft 124 of the fourth strut 174 is inserted into the fourth connector 184.

To use the invention 100, the headband 101 is put on the head 141 and the position of the sunshield 103 is adjusted by: 1) adjusting the radial angle 129 between the first shaft 121 and the second shaft 122 of the first strut 171 using the first pivot 126 of the first strut 171; 2) adjusting the radial angle 129 between the first shaft 121 and the second shaft 122 of the second strut 172 using the first pivot 126 of the second strut 172; 3) adjusting the radial angle 129 between the first shaft 121 and the second shaft 122 of the third strut 173 using the first pivot 126 of the third strut 173; 4) adjusting the radial angle 129 between the first shaft 121 and the second shaft 122 of the fourth strut 174 using the first pivot 126 of the fourth strut 174.

The air flow space 144 between the head 141 and the sunshield 103 is adjusted by: 1) adjusting the span of the third shaft 123 and the second shaft 122 of the first strut 171 by changing the relative positions of the third shaft 123 and the second shaft 122 within the threaded connector 125 of the first strut 171; 2) adjusting the span of the third shaft 123 and the second shaft 122 of the second strut 172 by changing the relative positions of the third shaft 123 and the second shaft 122 within the threaded connector 125 of the second strut 172; 3) adjusting the span of the third shaft 123 and the second shaft 122 of the third strut 173 by changing the relative positions of the third shaft 123 and the second shaft 122 within the threaded connector 125 of the third strut 173; 4) adjusting the span of the third shaft 123 and the second shaft 122 of the fourth strut 174 by changing the relative positions of the third shaft 123 and the second shaft 122 within the threaded connector 125 of the fourth strut 174.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Disk: As used in this disclosure, a disk is a cylindrically shaped object that is flat in appearance.

Elastic: As used in this disclosure, an elastic is a material or object that deforms when a force is applied to it and that is able to return to its original shape after the force is removed. A material that exhibits these qualities is also referred to as an elastomeric material.

Elastic band: As used in this disclosure, an elastic band is a loop of textile that is formed using elastic material that can stretched. Alternatively, the elastic band can be a sheeting that is formed from latex, spandex, or an elastic plastic film that can be stretched.

Exterior Screw Thread: An exterior screw thread is a ridge wrapped around the outer surface of a tube in the form of a helical structure that is used to convert rotational movement into linear movement.

Fastener: As used in this disclosure, a fastener device that is used to join or affix two objects. Fasteners generally comprise a first element, which is attached to the first object and a second element which is attached to the second object such that the first element and the second element join to affix the first object and the second object. Common examples of fasteners include, but are not limited to, zippers, snaps, buttons, buckles, quick release buckles, or hook and loop fasteners.

Filtering Material: As used in this disclosure, a filtering material refers to an object or material that prevents or inhibits the passage of radiation of specific wavelengths through the object or material.

Inner Diameter: As used in this disclosure, the term inner diameter is used in the same way that a plumber would refer to the inner diameter of a pipe.

Interior Screw Thread: An interior screw thread is a groove that is formed around the inner surface of a tube in the form of a helical structure that is used to convert rotational movement into linear movement.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Modulus: As used in this disclosure, the modulus of an elastic textile or elastic sheeting is a function that describes the percentage change in the span of the fabric as a function of the force applied to the elastic textile or elastic sheeting.

Opaque: As used in this disclosure, opaque refers to an object or material that prevents the passage of radiation through the object or material.

Outer Diameter: As used in this disclosure, the term outer diameter is used in the same way that a plumber would refer to the outer diameter of a pipe.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural. Sheeting: As used in this disclosure, sheeting is a material, such as cloth or plastic, in the form of a thin flexible layer or layers.

Snap: As used in this disclosure, a snap is a fastener that comprises a male component and a female component. The snap is engaged by pressing the male component into the female component.

Textile: As used in this disclosure, a textile is a material that is woven, knitted, braided or felted. Synonyms in common usage for this definition include fabric and cloth.

Ultraviolet Light: As used in this disclosure, ultraviolet light is understood to be electromagnetic radiation with a wavelength lesser than visible light. In general usage, ultraviolet light is taken to mean electromagnetic radiation with a wavelength less than 400 nm.

UV: As used in this disclosure, UV is an abbreviation for ultraviolet.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hat comprising:

a headband, a plurality of struts, a sunshield, and a plurality of snaps;

wherein the hat is adapted to be an apparel item;

wherein the hat is adapted to be worn on the head;

wherein the hat is a UV blocking sunshield attached to the head such that UV radiation is prevented from reaching the head, the ears, or the nape of the neck of a person wearing the hat;

wherein the plurality of struts attach to the headband with the plurality of snaps;

wherein the plurality of struts attach to the sunshield;

wherein the headband is worn on the head;

wherein the sunshield is raised above the head to create a space available for air flow;

wherein the amount of space available for air flow is adjustable;

wherein the position of the sunshield relative to a source of radiation is adjustable;

wherein the plurality of snaps further comprises a plurality of male snaps and a plurality of female snaps;

wherein any male snap selected from the plurality of male snaps will attach to any female snap selected from the plurality of female snaps;

wherein the headband comprises an elastic band;

wherein the headband has a modulus such that the relaxation force of the elasticity of the elastic band will provide adequate friction against the head such that the plurality of struts and the sunshield is supported by the headband;

wherein the headband further comprises a first plurality of fasteners;

wherein the first plurality of fasteners is selected from the group consisting of the plurality of male snaps or the plurality of female snaps;

wherein the first plurality of fasteners attach to the headband;

wherein each of the plurality of struts comprises a first shaft, a second shaft, a third shaft, a fourth shaft, a threaded connector, a pivot, a second plurality of fasteners, and a mounting plate;

wherein the first shaft is a shaft that is further defined with a first end and a second end;

wherein the second shaft is a shaft that is further defined with a third end and a fourth end;

wherein the fourth end is formed with an exterior screw thread;

wherein the third shaft is a shaft that is further defined with a fifth end and a sixth end;

wherein the fifth end is formed with an exterior screw thread;

wherein the fourth shaft is a shaft that is further defined with a seventh end and an eighth end;

wherein the threaded connector and the pivot interconnect the first shaft, the second shaft, the third shaft, and the fourth shaft;

wherein the mounting plate is a rectangular plate upon which the second plurality of fasteners are attached to;

wherein the second plurality of fasteners are a subset of fasteners selected from the group remaining in the group consisting of the plurality of male snaps or the plurality of female snaps after the first plurality of fasteners has been selected;

wherein the second plurality of fasteners are positioned on the mounting plate such that the second plurality of fasteners align with a selected subset of the first plurality of fasteners such that the second plurality of fasteners attach to the selected subset of the first plurality of fasteners;

wherein the threaded connector is a pipe;

wherein the threaded connector is formed with an interior screw thread;

wherein the threaded connector is further defined with a ninth end and a tenth end;

wherein the span of the inner diameter of the threaded connector is greater than the span of the outer diameter of the second shaft;

wherein the span of the inner diameter of the threaded connector is greater than the span of the outer diameter of the third shaft;

wherein the pivot adjusts the radial angle between the first shaft and the second shaft;

wherein the mounting plate is attached to the first end of the first shaft;

wherein the second end of the first shaft is attached to a pivot;

wherein the third end of the second shaft is attached to the pivot;

wherein the fourth end of the second shaft screws into the ninth end of the threaded connector;

wherein the fifth end of the third shaft screws into the tenth end of the threaded connector;

wherein the seventh end of the fourth shaft is attached to the sixth end of the third shaft such that a center axis of the fourth shaft is perpendicular to a center axis of the third shaft.

2. The hat according to claim 1 wherein the sunshield comprises a barrier;

wherein the barrier is the physical barrier that inhibits the UV radiation from reaching the head.

3. The hat according to claim 2 wherein the barrier is made from a material selected from the group consisting of an opaque material or a filtering material that inhibits the passage of radiation with wavelengths less than 400 nm.

4. The hat according to claim 3 wherein the sunshield further comprises a barrier further comprises a plurality of connectors;

wherein each of the plurality of connectors receives the eight end of a strut selected from the plurality of struts.

5. The hat according to claim 4 wherein each of the plurality of connectors is a two holed pipe strap.

6. The hat according to claim 4 wherein the plurality of struts further comprises a first strut, a second strut, a third strut, and a fourth strut.

7. The hat according to claim 6 wherein the plurality of connectors further comprises a first connector, a second connector, a third connector, and a fourth connector.

8. The hat according to claim 7 wherein the eighth end of the fourth shaft of the first strut is inserted into the first connector;

wherein the eighth end of the fourth shaft of the second strut is inserted into the second connector;

wherein the eighth end of the fourth shaft of the third strut is inserted into the third connector;

wherein the eighth end of the fourth shaft of the fourth strut is inserted into the fourth connector.

9. The hat according to claim 8 wherein the position of the sunscreen is adjusted by adjusting the radial angle between the first shaft and the second shaft of the first strut using the first pivot of the first strut;

wherein the position of the sunscreen is adjusted by adjusting the radial angle between the first shaft and the second shaft of the second strut using the first pivot of the second strut;

wherein the position of the sunscreen is adjusted by adjusting the radial angle between the first shaft and the second shaft of the third strut using the first pivot of the third strut;

wherein the position of the sunscreen is adjusted by adjusting the radial angle between the first shaft and the second shaft of the fourth strut using the first pivot of the fourth strut.

10. The hat according to claim 9 wherein the air flow space between the head and the sunshield is adjusted by adjusting the span of the third shaft and the second shaft of the first strut by changing the relative positions of the third shaft and the second shaft within the threaded connector of the first strut;

wherein the air flow space between the head and the sunshield is adjusted by adjusting the span of the third shaft and the second shaft of the second strut by changing the relative positions of the third shaft and the second shaft within the threaded connector of the second strut;

wherein the air flow space between the head and the sunshield is adjusted by adjusting the span of the third shaft and the second shaft of the third strut by changing the relative positions of the third shaft and the second shaft within the threaded connector of the third strut;

wherein the air flow space between the head and the sunshield is adjusted by adjusting the span of the third shaft and the second shaft of the fourth strut by changing the relative positions of the third shaft and the second shaft within the threaded connector of the fourth strut.

11. The hat according to claim 10 wherein each of the plurality of connectors is a two holed pipe strap.

* * * * *